US011732628B1

(12) United States Patent
Turney

(10) Patent No.: US 11,732,628 B1
(45) Date of Patent: Aug. 22, 2023

(54) DIESEL EXHAUST FLUID

(71) Applicant: Old World Industries, LLC, Northbrook, IL (US)

(72) Inventor: John Turney, Northbrook, IL (US)

(73) Assignee: Old World Industries, LLC, Northbrook, IL (US)

( * ) Notice: Subject to any disclaimer, the term of this patent is extended or adjusted under 35 U.S.C. 154(b) by 0 days.

(21) Appl. No.: 17/398,383

(22) Filed: Aug. 10, 2021

Related U.S. Application Data

(60) Provisional application No. 63/064,613, filed on Aug. 12, 2020.

(51) Int. Cl.
*F01N 3/20* (2006.01)
*F01N 3/04* (2006.01)

(52) U.S. Cl.
CPC ..... *F01N 3/2066* (2013.01); *F01N 3/04* (2013.01); *F01N 2430/04* (2013.01); *F01N 2570/18* (2013.01); *F01N 2610/02* (2013.01); *F01N 2610/102* (2013.01); *F01N 2900/18* (2013.01); *F01N 2900/1806* (2013.01)

(58) Field of Classification Search
CPC combination set(s) only.
See application file for complete search history.

(56) References Cited

U.S. PATENT DOCUMENTS 4,695,411 A 9/1987 Stern et al.
4,920,691 A 5/1990 Fainman
5,057,293 A 10/1991 Epperly et al.
5,080,825 A 1/1992 Bradshaw
5,286,467 A 2/1994 Sun et al.
5,298,230 A 3/1994 Argabright
5,389,113 A 2/1995 Demmering et al.
5,404,841 A 4/1995 Valentine
5,441,713 A 8/1995 Dubin et al.
5,453,257 A 9/1995 Diep
5,489,419 A 2/1996 Diep et al.
5,535,708 A 7/1996 Valentine
5,536,482 A 7/1996 Diep et al.
5,540,047 A 7/1996 Dahlheim
5,584,265 A 12/1996 Rao
5,645,756 A 7/1997 Dubin et al.
5,658,547 A 8/1997 Michalak
5,752,989 A 5/1998 Henly
5,785,937 A 7/1998 Neufert
(Continued)

FOREIGN PATENT DOCUMENTS

DE 4040317 6/1992
DE 4446773 B4 6/1996
(Continued)

OTHER PUBLICATIONS

M. Koebel et al., Urea-SCR: a promising technique to reduce NOx emissions from automotive diesel engines, Catalysis Today, 59 (2000), pp. 335-345.

(Continued)

*Primary Examiner* — Binh Q Tran
(74) *Attorney, Agent, or Firm* — Husch Blackwell LLP

(57) ABSTRACT

A diesel exhaust fluid includes (a) water, (b) urea, (c) a 3-dimensional siloxane component, (d) optionally, a tridecyl alcohol ethoxylate, (e) optionally, an ammonium-containing salt, and (f) optionally, a titanium-containing salt or hydrate.

12 Claims, 3 Drawing Sheets

(56) References Cited

U.S. PATENT DOCUMENTS

| | | | | |
|---|---|---|---|---|
| 5,809,774 | A | 9/1998 | Peter-hoblyn | |
| 5,813,224 | A | 9/1998 | Rao | |
| 5,884,475 | A | 3/1999 | Hofmann | |
| 5,900,222 | A | 5/1999 | Ito | |
| 5,943,858 | A | 8/1999 | Hofmann | |
| 5,976,475 | A | 11/1999 | Peter-hoblyn | |
| 6,017,369 | A | 1/2000 | Ahmed | |
| 6,028,113 | A | 2/2000 | Scepanski et al. | |
| 6,051,040 | A | 4/2000 | Peter-hoblyn | |
| 6,060,522 | A | 5/2000 | Pallas et al. | |
| 6,119,448 | A | 9/2000 | Emmerling | |
| 6,209,313 | B1 | 4/2001 | Wissler | |
| 6,348,178 | B1 | 2/2002 | Sudduth | |
| 6,399,034 | B1 | 6/2002 | Weisweiler | |
| 6,415,602 | B1 | 7/2002 | Patchett | |
| 6,449,947 | B1 | 9/2002 | Liu | |
| 6,470,676 | B2 | 10/2002 | Dölling et al. | |
| 6,550,250 | B2 | 4/2003 | Mikkelsen et al. | |
| 6,601,385 | B2 | 8/2003 | Verdegan | |
| 6,713,030 | B1 | 3/2004 | Chandler | |
| 6,725,651 | B2 | 4/2004 | Itoh | |
| 6,755,014 | B2 | 6/2004 | Kawai | |
| 6,843,966 | B1 | 1/2005 | Mahr | |
| 6,863,874 | B1 | 3/2005 | Twigg | |
| 6,878,359 | B1 | 4/2005 | Mathes et al. | |
| 6,895,747 | B2 | 5/2005 | Upadhyay | |
| 6,928,807 | B2 | 8/2005 | Jacob | |
| 6,941,746 | B2 | 9/2005 | Tarabulski | |
| 6,959,540 | B2 | 11/2005 | Itoh | |
| 7,059,118 | B2 | 6/2006 | Ripper | |
| 7,065,958 | B2 | 6/2006 | Funk | |
| 7,093,427 | B2 | 8/2006 | Van | |
| 7,100,367 | B2 | 9/2006 | Schaller | |
| 7,200,990 | B2 | 4/2007 | Gabrielsson | |
| 7,241,431 | B2 | 7/2007 | Fischer | |
| 7,373,775 | B2 | 5/2008 | Breuer | |
| 7,459,135 | B2 | 12/2008 | Pieterse | |
| 7,467,749 | B2 | 12/2008 | Tarabulski | |
| 7,509,799 | B2 | 3/2009 | Amou | |
| 7,527,776 | B2 | 5/2009 | Golden | |
| 7,615,519 | B2 | 11/2009 | Esche et al. | |
| 7,652,072 | B2 | 1/2010 | Leatherman et al. | |
| 7,726,118 | B2 | 6/2010 | Oberski | |
| 7,802,419 | B2 | 9/2010 | Döring | |
| 7,947,241 | B2 | 5/2011 | Schmelzle et al. | |
| 7,950,224 | B2 | 5/2011 | Hara | |
| 7,964,032 | B2 | 6/2011 | Rajaraman et al. | |
| 3,071,079 | A1 | 12/2011 | DeCaire et al. | |
| 8,091,341 | B2 | 1/2012 | Fujino | |
| 8,371,113 | B2 | 2/2013 | Jochumsen | |
| 9,006,157 | B2 | 4/2015 | Piskoti | |
| 9,050,560 | B2 | 6/2015 | Wasow et al. | |
| 2002/0056273 | A1* | 5/2002 | Itoh | B01D 53/9431 60/285 |
| 2002/0058051 | A1 | 5/2002 | Nawaz et al. | |
| 2004/0020105 | A1 | 2/2004 | Burrington et al. | |
| 2004/0111955 | A1 | 6/2004 | Mullay et al. | |
| 2004/0118034 | A1 | 6/2004 | Williamson | |
| 2004/0123515 | A1 | 7/2004 | Krogh et al. | |
| 2005/0160663 | A1 | 7/2005 | Valentine | |
| 2005/0262759 | A1 | 12/2005 | Tort et al. | |
| 2006/0162237 | A1 | 7/2006 | Mullay et al. | |
| 2006/0213118 | A1 | 9/2006 | Mittelbach et al. | |
| 2006/0264505 | A1 | 11/2006 | Popp et al. | |
| 2007/0012032 | A1 | 1/2007 | Hu | |
| 2007/0231229 | A1 | 10/2007 | Rae et al. | |
| 2008/0295394 | A1 | 12/2008 | Furuta et al. | |
| 2009/0214397 | A1* | 8/2009 | Shirono | B01J 23/8913 422/177 |
| 2009/0311211 | A1 | 12/2009 | Chrobaczek et al. | |
| 2010/0139257 | A1* | 6/2010 | Driscoll | B01D 53/9409 60/299 |
| 2010/0293927 | A1* | 11/2010 | Johannessen | B01D 53/79 137/12 |
| 2012/0064136 | A1 | 3/2012 | Baker et al. | |
| 2013/0259755 | A1* | 10/2013 | Kim | F01N 3/208 422/111 |
| 2015/0315033 | A1* | 11/2015 | Gerhart | F01N 3/2066 60/274 |
| 2017/0356320 | A1* | 12/2017 | Gudorf | F01N 3/021 |
| 2021/0003060 | A1* | 1/2021 | Srinivasan | F01N 9/002 |

FOREIGN PATENT DOCUMENTS

| | | | | |
|---|---|---|---|---|
| EP | 0860494 | | 8/1998 | |
| EP | 1484385 | | 12/2004 | |
| EP | 1767755 | B1 | 3/2007 | |
| EP | 3600618 | * | 3/2021 | B01D 53/90 |
| FR | 2498622 | | 7/1982 | |
| GB | 2090612 | | 7/1982 | |
| GB | 2099449 | | 12/1982 | |
| WO | 96/28380 | | 9/1996 | |
| WO | 2000030733 | A1 | 6/2000 | |
| WO | 2000/75643 | A1 | 12/2000 | |
| WO | 2005/010130 | | 2/2005 | |
| WO | 2005025725 | A1 | 3/2005 | |
| WO | 2007/129055 | A1 | 11/2007 | |
| WO | 2008003508 | A1 | 1/2008 | |

OTHER PUBLICATIONS

Bittner et al., Catalytic Control of NOx, CO, and NMHC Emissions From Stationary Diesel and Dual-Fuel Engines, Journal of Engineering for Gas Turbines and Power, Jul. 1992, vol. 114, pp. 597-601.

Burgler et al., Strategies to meet US 1994/95 diesel engine federal emission legislation for HSDI diesel engine powered vehicles, Proceedings of the Institution of Mechanical Engineers, Part D: Journal of Automobile Engineering 206.1 (1992): 47-54.

Kwon, Y. et al., Potential of exhaust after treatment and engine technologies to meet future emissions limits, Concawe Report No. 99/62 (1999), 103 pages.

Twigg, Martyn V., Critical topics in exhaust gas aftertreatment, Platinum Metals Review 2001, 45, (4), pp. 176-178.

Singh, Gurpreet, Progress Report for Combustion and Emission Control for Advanced CIDI Engines, U.S. Department of Energy, Energy Efficiency and Renewable Energy Office of FreedomCAR and Vehicle Technologies, Nov. 2002, 222 pages.

Overman et al., Potential Emission Reduction Effects of Alternative Construction Equipment Control Measures. Report No. 4190-5, Project No. 0-4190. Texas Transportation Institute, Texas A&M University System, Jan. 2001, 70 pages.

Lindgren et al., Optimal measures in order to reduce total emissions from non-road mobile machinery in a national and economic perspective, SLU Department of Biometry and Engineering, ISSN 1652-3237, 2007, 94 pages.

Koebel et al., Recent advances in the development of urea-SCR for automotive applications, (2001). DOI: https://doi.org/10.4271/2001-01-3625, SAE Technical Paper 2001-01-3625, 2001, 12 pages.

* cited by examiner

DIESEL EXHAUST FLUID

CROSS-REFERENCE TO RELATED APPLICATIONS

This application claims priority to and is a non-provisional application of U.S. Provisional Application No. 63/064,613 filed Aug. 12, 2020, which is incorporated herein by reference in its entirety.

FIELD

The disclosure relates to a diesel exhaust fluid (DEF). In one embodiment, the disclosure relates to a DEF that reduces engine build up. In one embodiment, the disclosure relates to a DEF that reduces the formation of deposits in the diesel exhaust system. In another embodiment, the disclosure relates to a system comprising a diesel engine and a DEF.

BACKGROUND

Diesel exhaust fluid, or DEF, is a liquid used with diesel engines to reduce the amount of polluting emissions, and particularly nitrogen oxides. DEFs are injected into the hot exhaust stream and consumed during selective catalytic reduction (SCR) to reduce nitrogen oxides into nitrogen case, water and carbon dioxide.

SCR technology is one of the most cost-effective and fuel-efficient technologies available to help reduce diesel engine emissions. All heavy-duty diesel truck engines produced after Jan. 1, 2010 must meet the latest EPA emissions standards, among the most stringent in the world, reducing particulate matter (PM) and nitrogen oxides (NOx) to near zero levels. SCR can reduce NOx emissions up to 90 percent while simultaneously reducing HC and CO emissions by 50-90 percent, and PM emissions by 30-50 percent. SCR systems can also be combined with a diesel particulate filter to achieve even greater emission reductions for PM. In the commercial trucking industry, some SCR-equipped truck operators have reported fuel economy gains of 3-4 percent. Additionally, off-road equipment, including construction and agricultural equipment, must meet EPA's Tier 4 emissions standards requiring similar reductions in NOx, PM and other pollutants. SCR is one technology that can help off-road equipment meet these stringent emissions standards.

Since the inception of SCR, there have been issues with deposit build-up. Low speed operation, extended idling, short trips, and stop and go driving can prevent the SCR system from reaching and maintaining optimal temperatures, which can result in deposit buildup.

This deposit buildup can choke off the exhaust system causing a reduction of power and economy. Once this buildup accumulates, it can require time consuming disassembly, mechanical cleaning, or component replacement to make the system functional once again. Even worse, the engine can de-rate to a crawl or completely shut down until repairs are made, leaving the vehicle stranded on the road.

In addition to efficient removal of polluting emissions, it is desirable for a DEF to reduce deposit formation in the diesel exhaust system and to maintain or improve other aspects of performance of a diesel vehicle, including, for example, power, fuel efficiency, and engine buildup. Thus, there is a large need for a DEF that can address these concerns.

SUMMARY

In one embodiment, the disclosure provides a diesel exhaust fluid (DEF). In accordance with embodiments of the disclosure, a DEF comprises (a) water; (b) urea; (c) a 3-dimensional siloxane component; (d) optionally, an ammonium-containing salt; and (e) optionally, a titanium-containing salt or hydrate.

In another embodiment, a DEF comprises (a) water; (b) urea; (c) tridecyl alcohol ethoxylates; (d) a 3-dimensional siloxane component; (e) optionally, an ammonium-containing salt; and (f) optionally, a titanium-containing salt or hydrate.

In a further embodiment, the DEF comprises 45-75 wt % water, based on the total weight of the diesel exhaust fluid. In an embodiment, the DEF comprises 5-40 wt % urea, based on the total weight of the diesel exhaust fluid. In another embodiment, the DEF comprises 0.01-0.16 wt % tridecyl alcohol ethoxylates, based on the total weight of the diesel exhaust fluid. In still another embodiment, the DEF comprises 0.0001-0.5 wt % of the 3-dimensional siloxane component, based on the total weight of the diesel exhaust fluid. In a further embodiment, the DEF comprises the ammonium-containing salt in an amount from greater than 0 wt % to 30 wt %, based on the total weight of the diesel exhaust fluid. In another embodiment, the DEF comprises the titanium-containing salt or hydrate in an amount from greater than 0 wt % to 0.1 wt %, based on the total weight of the diesel exhaust fluid.

In an embodiment, the DEF comprises the ammonium-containing salt and the ammonium containing salt is selected from the group consisting of ammonium carbonate, ammonium chloride, ammonium nitrate, ammonium carbamate, ammonium formate, and combinations thereof. In an embodiment, the ammonium-containing salt, wherein the ammonium-containing salt is free from metals and transition metals. In another embodiment, the DEF comprises ammonium-containing salt and the ammonium-containing salt is selected from the group consisting of ammonium carbamate, ammonium formate, and combinations thereof.

In a further embodiment, the 3-dimensional siloxane component is an emulsion comprising a mixture of polymers containing siloxane units and terminating in trimethyl end caps dispersed in a water-based continuous phase. In yet another embodiment, the 3-dimensional siloxane component comprises at least one of polydimethyl siloxane, the reaction product of dimethyl siloxane and silica, the reaction products of polyethylene-polypropylene glycol monoallyl ether and vinyl group-terminated di-methyl siloxanes, and combinations thereof.

In an embodiment, the diesel exhaust fluid is used in the selective catalytic reduction of exhaust from a diesel engine.

In an embodiment, the diesel exhaust fluid is used to reduce deposits in a diesel exhaust system.

In another embodiment, the disclosure provides a diesel engine. In accordance with embodiments of the present disclosure, a diesel engine comprises a diesel exhaust fluid injector configured to inject an amount of DEF into an exhaust stream, wherein the diesel exhaust fluid comprises (a) water; (b) urea; (c) a 3-dimensional siloxane component; (d) optionally, an ammonium-containing salt; and (e) optionally, a titanium-containing salt or hydrate. In another embodiment, the diesel engine further comprises a selective catalytic reduction catalyst.

In accordance with embodiments of the present disclosure, a diesel engine comprises a diesel exhaust fluid injector configured to inject an amount of DEF into an exhaust stream, wherein the diesel exhaust fluid comprises (a) water; (b) urea; (c) tridecyl alcohol ethoxylates; (d) a 3-dimensional siloxane component; (e) optionally, an ammonium-containing salt; and (f) optionally, a titanium-containing salt or hydrate. In another embodiment, the diesel engine further comprises a selective catalytic reduction catalyst.

In another embodiment, the disclosure provides a method of reducing unwanted emissions in a diesel engine. In accordance with embodiments of the present disclosure, the method of reducing unwanted emissions in a diesel engine comprises injecting an amount of a diesel exhaust fluid into an exhaust stream of a diesel engine, the diesel exhaust fluid comprising (a) water; (b) urea; (c) a 3-dimensional siloxane component; (d) optionally, an ammonium-containing salt; and (e) optionally, a titanium-containing salt or hydrate; and subjecting the exhaust stream to selective catalytic reduction.

In another embodiment, the disclosure provides a method of reducing deposits in the diesel exhaust system. In accordance with embodiments of the present disclosure, the method of reducing deposits in the diesel exhaust system comprises injecting an amount of a diesel exhaust fluid into an exhaust stream of a diesel engine, the diesel exhaust fluid comprising (a) water; (b) urea; (c) a 3-dimensional siloxane component; (d) optionally, an ammonium-containing salt; and (e) optionally, a titanium-containing salt or hydrate; and subjecting the exhaust stream to selective catalytic reduction.

In another embodiment, the disclosure provides a method of reducing unwanted emissions in a diesel engine. In accordance with embodiments of the present disclosure, the method of reducing unwanted emissions in a diesel engine comprises injecting an amount of a diesel exhaust fluid into an exhaust stream of a diesel engine, the diesel exhaust fluid comprising (a) water; (b) urea; (c) tridecyl alcohol ethoxylates; (d) a 3-dimensional siloxane component; (e) optionally, an ammonium-containing salt; and (f) optionally, a titanium-containing salt or hydrate; and subjecting the exhaust stream to selective catalytic reduction.

In another embodiment, the disclosure provides a method of reducing deposits in the diesel exhaust system. In accordance with embodiments of the disclosure, the method of reducing deposits in the diesel exhaust system comprises injecting an amount of a diesel exhaust fluid into an exhaust stream of a diesel engine, the diesel exhaust fluid comprising (a) water; (b) urea; (c) tridecyl alcohol ethoxylates; (d) a 3-dimensional siloxane component; (e) optionally, an ammonium-containing salt; and (f) optionally, a titanium-containing salt or hydrate; and subjecting the exhaust stream to selective catalytic reduction.

DETAILED DESCRIPTION

Figure 1:
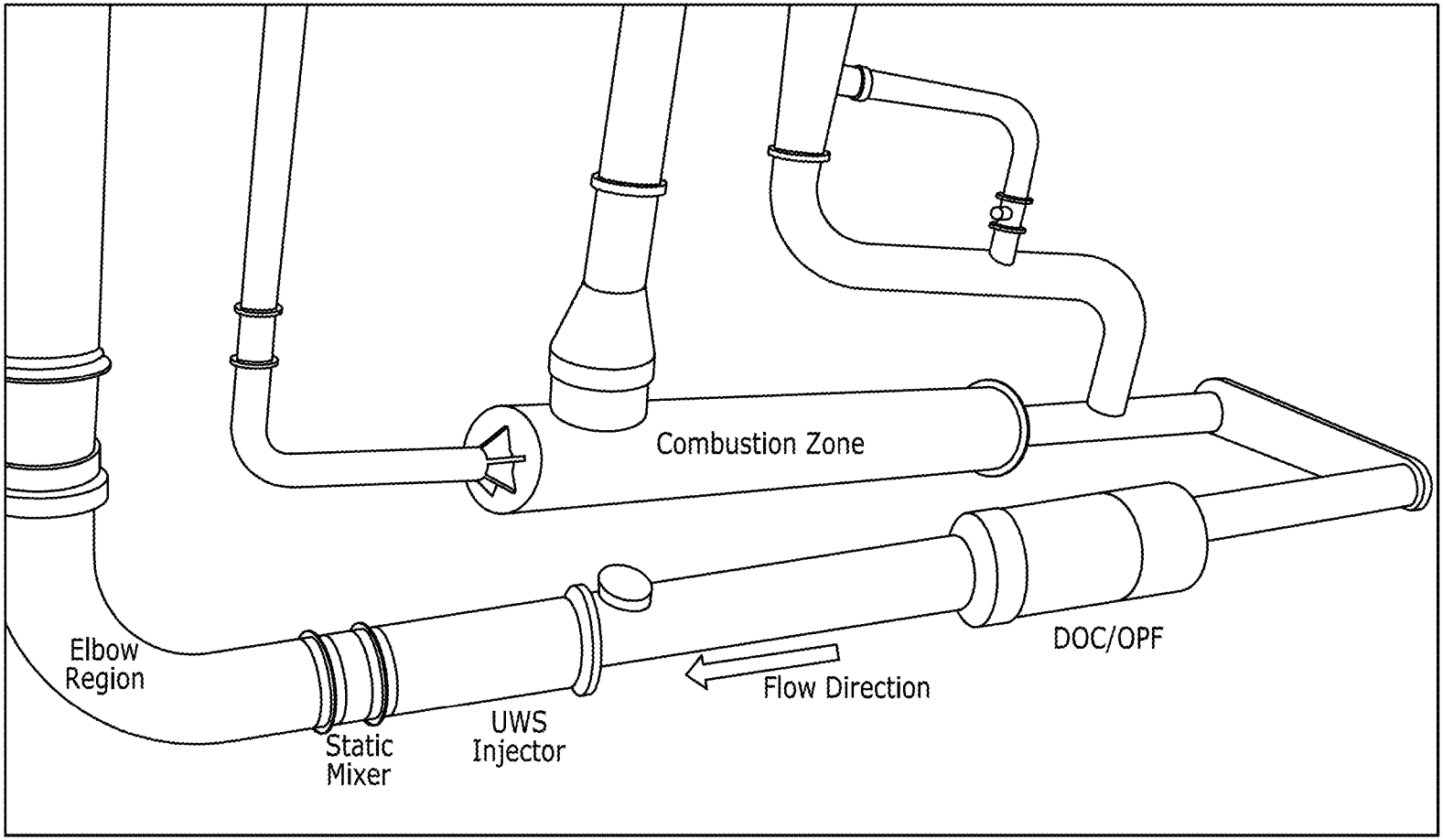
FIG. 1 is a schematic of the laboratory testing set-up used to evaluate the performance of DEF formulations disclosed herein.

Before explaining embodiments of the disclosure in detail, it is to be understood that the disclosure is not limited in its application to the details of construction and the arrangement of the components set forth in the following description or illustrated in the drawings. The technology of this present disclosure is capable of other embodiments or being practiced or carried out in various ways. Also, it is to be understood that the phraseology and terminology employed herein is for the purpose of description and should not be regarded as limiting.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, melt index, temperature, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, relative amounts of components in a mixture, and various temperature and other parameter ranges recited in the methods.

The terms "comprising," "including," "having" and like terms are not intended to exclude the presence of any additional component, step or procedure, whether or not the same is specifically disclosed. All processes claimed through use of "comprising" may include one or more additional steps, pieces of equipment or component parts, and/or materials unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed. The term "or," unless stated otherwise, refers to the listed members individually as well as in any combination.

In one embodiment, the disclosure provides a DEF comprising (a) water, (b) urea, (c) a 3-dimensional siloxane component, and, optionally, (d) an ammonium-containing salt or combinations thereof and/or (e) a titanium-containing salt or hydrate or combinations thereof.

In another embodiment, the disclosure provides a DEF comprising (a) water, (b) urea, (c) tridecyl alcohol ethoxylates, (d) a 3-dimensional siloxane component, and, optionally, (e) an ammonium-containing salt or combinations thereof and/or (f) a titanium-containing salt or hydrate or combinations thereof.

Water

According to embodiments of the disclosure, the DEF comprises water, preferably purified water. Water can be purified by different mechanisms, including, but not limited to, filtration, distillation, deionization and combinations thereof. In a preferred embodiment, the water is deionized water.

The DEF comprises from 45 wt %, or 50 wt %, or 52 wt %, or 55 wt %, or 58 wt %, or 60 wt % to 62 wt %, or 65 wt %, or 68 wt %, or 70 wt %, or 75 wt % water, based on the total weight of the DEF composition. In a preferred embodiment, the DEF composition comprises from 52 wt %, or 54 wt %, or 56 wt %, or 58 wt %, or 60 wt % to 62 wt %, or 64 wt %, or 66 wt %, or 68 wt % water, based on the total weight of DEF composition.

Urea

Urea is an organic compound having the formula $CO(NH_2)_2$. In a DEF in use with a diesel engine, urea decomposes into ammonia in the exhaust stream. The ammonia reduces the nitrogen oxides in the exhaust.

The DEF comprises from 5 wt %, or 10 wt %, or 15 wt %, or 20 wt % to 25 wt %, or 30 wt %, or 35 wt %, or 40 wt % urea, based on the total weight of the DEF composition. In a preferred embodiment, the DEF composition comprises from 10 wt %, or 12 wt %, or 15 wt %, or 18 wt % to 20 wt %, or 22 wt %, or 25 wt %, or 28 wt %, or 30 wt %, or 32 wt %, or 35 wt % urea, based on the total wight of the DEF composition.

3-Dimensional Siloxane Component

The 3-dimensional siloxane component is an emulsion comprising silicon-containing compounds as a dispersed phase in a water-based continuous phase.

In an embodiment, the water-based continuous phase comprises purified water, such as described previously herein. The purified water is purified by filtration, distillation, deionization, or combinations thereof. In an embodiment, the purified water is deionized water.

Water is the majority constituent of the 3-dimensional siloxane component. In an embodiment, water is present in the 3-dimensional siloxane component in an amount from greater than 50 wt %, or 55 wt %, or 60 wt % to 65 wt %, or 70 wt %, or 75 wt %, based on the total weight of the 3-dimensional siloxane component. Preferably, the 3-dimensional siloxane component comprises water in an amount from 60 wt %, or 62 wt %, or 64 wt % to 66 wt %, or 68 wt %, or 70 wt %, or 72 wt %, based on the total weight of the 3-dimensional siloxane component.

In an embodiment, the silicon-containing compounds comprise a mixture of polymers containing siloxane units, with a majority of the siloxane-containing polymers terminating in trimethyl end caps. Exemplary silicon-containing compounds for use in the 3-dimensional siloxane component include, but are not limited to, poly(dimethylsiloxane), the reaction product of dimethyl siloxane and silica, reaction products of polyethylene-polypropylene glycol monoallyl ether and vinyl group-terminated di-methyl siloxanes, and combinations thereof.

The silicon-containing compounds are present in the 3-dimensional siloxane component in an amount from 20 wt %, or 25 wt %, or 30 wt % to 35 wt %, or 40 wt %, or 45 wt %, based on the total weight of the 3-dimensional siloxane component. Preferably, the silicon-containing compounds are present in the 3-dimensional siloxane component in an amount from 24 wt %, or 26 wt %, or 28 wt %, or 30 wt % to 32 wt %, or 34 wt %, or 36 wt %, or 38 wt %, or 40 wt %, based on the total weight of the 3-dimensional siloxane component.

In a particular embodiment the silicon-containing compounds include poly(dimethylsiloxane), or PDMS. PDMS is a polymeric organosilicon having repeating units of —OSi$(CH_3)$— and terminated in $Si(CH_3)_3$ groups. In such an embodiment, the amount of PDMS in the 3-dimensional siloxane emulsion is from 5 wt %, or 6 wt %, or 7 wt %, or 8 wt % to 9 wt %, or 10 wt %, or 11 wt %, or 12 wt %, based on the total weight of the 3-dimensional siloxane emulsion. In a preferred embodiment, the amount of PDMS in the 3-dimensional siloxane emulsion is from 7.0 wt %, or 7.5 wt % to 8.0 wt %, or 8.5 wt %, or 9.0 wt %, based on the total weight of the 3-dimensional siloxane emulsion.

In a particular embodiment, the silicon-containing compounds include the reaction product of dimethyl siloxane and silica. Exemplary reaction product of dimethyl siloxane and silica is available as CAS 1402600-37. In such an embodiment, the amount of the reaction product of dimethyl siloxane and silica in the 3-dimensional siloxane component is from 5 wt %, or 5.5 wt %, or 6 wt %, or 6.5 wt % to 7 wt %, or 7.5 wt %, or 8 wt %, or 8.5 wt %, or 9 wt %, or 10 wt %, and preferably from 6.0 wt %, or 6.25 wt %, or 6.5 wt %, or 6.75 wt % to 7.0 wt %, or 7.25 wt %, or 7.5 wt %, or 7.75 wt %, or 8.0 wt %, based on the total weight of the 3-dimensional siloxane component.

In a particular embodiment, the silicon-containing compounds include the reaction products of polyethylene-polypropylene glycol monoallyl ether and vinyl group-terminated di-methyl siloxanes. Such reaction products are available as CAS 191233-73-5. In such an embodiment, the reaction products of polyethylene-polypropylene glycol monoallyl ether and vinyl group-terminated di-methyl siloxanes are present in an amount from 9 wt %, or 9.5 wt %, or 10 wt %, or 10.5 wt %, or 11 wt %, or 11.5 wt % to 12 wt %, or 12.5 wt %, or 13 wt %, or 13.5 wt %, or 14 wt %, or 15 wt %, or 16 wt %, and preferably from 11 wt %, or 11.25 wt %, or 11.5 wt %, or 11.75 wt %, or 12 wt % to 12.25 wt %, or 12.5 wt %, or 12.75 wt %, or 13 wt %, or 13.5 wt %, or 14 wt %, based on the total weight of the 3-dimensional siloxane component.

Other components may be present in the 3-dimensional siloxane component, such as, for example, to stabilize the emulsion or to otherwise improve one or more of its various properties or aid in manufacture. Exemplary additional components include, but are not limited to, epoxides, ethers, polyethylene glycol, polypropylene glycol, polyethylene-polypropylene glycol, and combinations thereof. Such additional components are provided in the 3-dimensional siloxane emulsion in an amount from 0 wt %, or greater than 0 wt %, or 0.5 wt %, or 1.0 wt %, or 1.5 wt % to 2.0 wt %, or 2.5 wt %, or 3 wt %, or 3.5 wt %, or 4 wt %, or 4.5 wt %, or 5.0 wt % in total, based on the total weight of the 3-dimensional siloxane component. Preferably the amount of such additional components in the 3-dimensional siloxane component is from 0.5 wt %, or 0.75 wt %, or 1.0 wt %, or 1.25 wt %, or 1.5 wt %, or 1.75 wt % to 2.0 wt %, or 2.25 wt %, or 2.5 wt %, or 2.75 wt %, or 3.0 wt %, or 3.25 wt %, or 3.5 wt %, or 3.75 wt %, based on the total weight of the 3-dimensional siloxane component.

In an embodiment, the 3-dimensional siloxane component includes polyethylene-polypropylene glycol. In such an embodiment, the polyethylene-polypropylene glycol is present in the 3-dimensional siloxane emulsion in an amount from 0.5 wt %, or 0.75 wt %, or 1.0 wt %, or 1.25 wt %, or 1.5 wt %, based on the total weight of the 3-dimensional siloxane emulsion. In a preferred embodiment, the polyethylene-polypropylene glycol is present in an amount from 0.6 wt %, or 0.7 wt %, or 0.8 wt %, or 0.9 wt % to 1.0 wt %, or 1.1 wt %, or 1.2 wt %, or 1.3 wt %, or 1.4 wt %.

In an embodiment, the 3-dimensional siloxane component includes oxirane, methyl-, polymer with oxirane, mono-2-propynyl ether. Oxirane, methyl-, polymer with oxirane, mono-2-propynyl ether is a compound having the formula $C_{11}H_{20}O_3$, resulting in a mixture of three structures being present, specifically, a blend of allyl ether, ethylene oxide and propylene oxide. An exemplary oxirane, methyl-, polymer with oxirane, mono-2-propynyl ether is available as CAS 9041-33-2. The oxirane, methyl-, polymer with oxirane, mono-2-propynyl ether is present in the 3-dimensional siloxane emulsion in an amount from 0.5 wt %, or 0.75 wt %, or 1.0 wt %, or 1.25 wt %, or 1.5 wt % to 1.75 wt %, or 2.0 wt %, or 2.25 wt %, or 2.5 wt %, or 2.75 wt %, or 3.0 wt %. In a preferred embodiment, the oxirane, methyl-, polymer with oxirane, mono-2-propynyl ether is present in an amount from 1.0 wt %, or 1.2 wt %, or 1.4 wt %, or 1.6 wt % to 1.8 wt %, or 2.0 wt %, or 2.2 wt %, or 2.4 wt %.

The DEF comprises from 0.0001 wt %, or 0.0005 wt %, or 0.001 wt %, or 0.005 wt %, or 0.01 wt % to 0.05 wt %, or 0.1 wt %, or 0.5 wt % 3-dimensional siloxane component, based on the total weight of the DEF composition. In a preferred embodiment, the DEF composition comprises from 0.005 wt %, or 0.0075 wt %, or 0.01 wt % to 0.025 wt %, or 0.05 wt %, or 0.075 wt %, or 0.1 wt % 3-dimensional siloxane component, based on the total weight of the DEF composition.

Fatty Alcohol Ethoxylates

In one embodiment, the DEF contains a fatty alcohol ethoxylate. Fatty alcohol ethoxylates are non-ionic surfactants that contain both hydrophobic tail portion (fatty alcohol part) and hydrophilic polar head groups (ethoxy chain part), and are thus tend to dissolve in both aqueous and oil phase and to reduce the surface tension of liquids. Ethylene oxide (also called epoxyethane and oxirane) is the simplest cyclic ether or epoxide, with the formula $C_2H_4O$; reactive material that is added to the base of alcohols (or amines) to form ethoxylated surfactants. The Hydrophilic-Lipophilic Balance (HLB) of EO surfactant is related to the hydrophilic portion of the molecule. More hydrophilic groups enable more solubility in water as more hydrogen bondings exist.

Representative examples of fatty alcohol ethoxylate are show in Table 1 below.

TABLE 1

Representative Examples of Fatty Alcohol Ethoxylates

| Products | Carbon length |
|---|---|
| Alkyl Alcohol ethoxylate | |
| Alkyl Alcohol (C6-C12) ethoxylates | 6-12 |
| Alkyl Alcohol (C8-C22) ethoxylates | 8-22 |
| Alkyl Alcohol (C8-C10)ethoxylates | 8-10 |
| Alkyl Alcohol (C8-C18) ethoxylates | 8-18 |
| Alkyl Alcohol (C8-C16) ethoxylates | 8-16 |
| Coco alcohol ethoxylates | 8-18 |
| Alkyl Alcohol (C9-C11) ethoxylates | 9-11 |
| Branched Alkyl Alcohols (C9-C11) ethoxylates | 9-11 |
| Alkyl Alcohol (C9-C16) ethoxylates | 9-16 |
| Alkyl Alcohol (C10-C14) ethoxylates | 10-14 |
| Alkyl Alcohol (C10-C16) ethoxylates | 10-16 |
| Isodecyl ethoxylates | 10 |
| Decyl alcohol ethoxylates | 10 |
| Alkyl Alcohol (C10-C12) ethoxylates | 10-12 |
| Branched Alkyl Alcohol (C11-C13) ethoxylates | 11-13 |
| Branched Alkyl Alcohol (C11-C14) ethoxylates | 11-14 |
| Undecyl alcohol ethoxylates | 11 |
| Linear Undecyl alcohol ethoxylates | 11 |
| Secondary Alcohol (C11-C15) ethoxylates | 11-15 |

TABLE 1-continued

Representative Examples of Fatty Alcohol Ethoxylates

| Products | Carbon length |
|---|---|
| Alkyl Alcohol (C12-C13) ethoxylates | 12-13 |
| Alkyl Alcohol (C12-C20) ethoxylates | 12-20 |
| Secondary Alcohol (C12-C14) ethoxylates | 12-14 |
| Alkyl Alcohol (C12-C14) ethoxylates | 12-14 |
| Alkyl Alcohol (C12-C18) ethoxylates | 12-18 |
| Alkyl Alcohol (C12-C16) ethoxylates | 12-16 |
| Dodecyl alcohol ethoxylates | 12 |
| Linear Alkyl Alcohol (C12-C15) ethoxylates | 12-15 |
| Alkyl Alcohol (C12-C15) ethoxylates | 12-15 |
| Tridecyl alcohol ethoxylates | 13 |
| Alkyl Alcohol (C13-C15) ethoxylates | 13-15 |
| Isotridecanol ethoxylates | 13 |
| Isotridecyl alcohol ethoxylates | 13 |
| Alkyl Alcohol (C14-C15) ethoxylates | 14-15 |
| Tetradecyl ethoxylates | 14 |
| Alkyl Alcohol (C16-C22) ethoxylates | 16-22 |
| Alkyl Alcohol (C16-C18) ethoxylates | 16-18 |
| Unsaturated Alkyl Alcohol (C16-C18) ethoxylates | 16-18 |
| Tallow alcohol ethoxylates | 16-18 |
| Hexadecyl alcohol ethoxylates | 16 |
| unsaturated alkyl Alcohol (C16-C18) ethoxylates | 16-18 |
| Stearyl alcohol ethoxylates | 18 |
| Oleyl alcohol ethoxylates | 18 |

In one embodiment, the DEF contains a tridecyl alcohol ethoxylate. As used herein, "tridecyl alcohol ethoxylates" refers to a mixture of alkyl ethers having the general formula $C_{13}H_{27}(OCH_2CH_2)_nOH$, wherein the tridecyl ether group is a mixture of $C_{11}$ to $C_{14}$ alkyl ethers with the $C_{13}$ being the dominant constituent of the mixture and n is from 6 to 14. In one embodiment, the tridecyl ether group is a mixture of $C_{11}$ to $C_{14}$ alkyl ethers with the $C_{13}$ being the dominant constituent of the mixture and n is 6. In another embodiment, the tridecyl ether group is a mixture of $C_{11}$ to $C_{14}$ alkyl ethers with the $C_{13}$ being the dominant constituent of the mixture and n is 9. In yet another embodiment, the tridecyl ether group is a mixture of $C_{11}$ to $C_{14}$ alkyl ethers with the $C_{13}$ being the dominant constituent of the mixture and n is 10. In still another embodiment, the tridecyl ether group is a mixture of $C_{11}$ to $C_{14}$ alkyl ethers with the $C_{13}$ being the dominant constituent of the mixture and n is 11. In yet another embodiment, the tridecyl ether group is a mixture of $C_{11}$ to $C_{14}$ alkyl ethers with the $C_{13}$ being the dominant constituent of the mixture and n is 12. In still another embodiment, the tridecyl ether group is a mixture of $C_{11}$ to $C_{14}$ alkyl ethers with the $C_{13}$ being the dominant constituent of the mixture and n is 14. An exemplary tridecyl alcohol ethoxylate mixture is available as CAS 78330-21-9.

In one embodiment, the tridecyl alcohol ethoxylates has a hydrophilic lipophilic balance of 18, or 19, or 20. In one embodiment, the tridecyl alcohol ethoxylates has a hydrophilic lipophilic balance greater than 17.

In one embodiment, the DEF composition comprises tridecyl alcohol ethoxylates in an amount from 0.01 wt %, or 0.02 wt %, or 0.03 wt %, or 0.04 wt %, or 0.05 wt %, or 0.06 wt % to 0.07 wt %, or 0.08 wt %, or 0.09 wt %, or 0.10 wt %, or 0.12 wt %, or 0.14 wt %, or 0.16 wt %, based on the total weight of the DEF composition. In a preferred embodiment, the DEF composition comprises from 0.04 wt %, or 0.05 wt %, or 0.06 wt % to 0.07 wt %, or 0.08 wt %, or 0.09 wt %, or 0.10 wt % tridecyl alcohol ethoxylates, based on the total weight of DEF composition.

Ammonium-Containing Salt

An ammonium-containing is a salt having ammonium cations. Nonlimiting examples of ammonium-containing salts include ammonium carbonate, ammonium chloride, ammonium nitrate, ammonium carbamate, ammonium formate, and combinations thereof. In a preferred embodiment, the ammonium-containing salt is selected from the group consisting of ammonium carbamate, ammonium formate, and combinations thereof.

In an embodiment, ammonium-containing salts are free from metals and transition metals.

In an embodiment, the DEF composition includes an ammonium-containing salt or hydrate. In such an embodiment, the amount of ammonium-containing salt is present in the DEF composition in an amount of greater than 0 wt %, or 0.05 wt %, or 0.1 wt %, or 1 wt %, or 5 wt % to 10 wt %, or 15 wt %, or 20 wt %, or 25 wt %, or 30 wt %, based on the total weight of the DEF composition. In a preferred embodiment, the ammonium-containing salt is present in the DEF composition in an amount of 0.05 wt %, or 0.1 wt %, 0.5 wt %, or 1.0 wt %, or 1.5 wt % to 2 wt %, or 3 wt %, or 4 wt %, or 5 wt %, based on the total weight of the DEF composition.

In an embodiment, the ammonium-containing salt is a single compound and the ammonium-containing salt is present in the DEF composition in an amount of greater than 0 wt %, or 0.05 wt %, or 0.1 wt %, or 1 wt %, or 5 wt % to 10 wt %, or 15 wt %, or 20 wt %, or 25 wt %, or 30 wt %, or preferably from 0.05 wt %, or 0.1 wt %, 0.5 wt %, or 1.0 wt %, or 1.5 wt % to 2 wt %, or 3 wt %, or 4 wt %, or 5 wt %, based on the total weight of the DEF composition. In another embodiment, the ammonium-containing salt comprises two or more ammonium-containing salts, and the total amount of ammonium-containing salts in the DEF composition is from greater than 0 wt %, or 0.05 wt %, or 0.1 wt %, or 1 wt %, or 5 wt % to 10 wt %, or 15 wt %, or 20 wt %, or 25 wt %, or 30 wt %, or preferably from 0.05 wt %, or 0.1 wt %, 0.5 wt %, or 1.0 wt %, or 1.5 wt % to 2 wt %, or 3 wt %, or 4 wt %, or 5 wt %, based on the total weight of the DEF composition.

In another embodiment, the ammonium-containing salt comprises two or more ammonium-containing salts, and the total amount of ammonium-containing salts in the DEF composition is from 1 wt %, or 2 wt %, or 3 wt %, or 4 wt % to 5 wt %, or 6 wt %, or 7 wt %, or 8 wt %, or 9 wt %, or 10 wt %, or 12 wt %, or preferably from 1 wt %, or 1.25 wt %, or 1.5 wt %, or 1.75 wt %, or 2 wt to 2.25 wt %, or 2.5 wt %, or 2.75 wt %, or 3 wt %, or 3.25 wt %, or 3.5 wt %, based on the total weight of the DEF composition.

Titanium-Containing Salt or Hydrate

A titanium-containing salt is a salt having titanium in its structure, while a titanium-containing hydrate is a hydrated titanium-containing salt. Nonlimiting examples of titanium-containing salts include titanium lactate ammonium salt. Nonlimiting examples of titanium-containing hydrates include ammonium titanyl oxalate monohydrate.

The titanium-containing salt or hydrate is present in the DEF composition in an amount from greater than 0 wt %, or 0.0001 wt %, or 0.0005 wt %, or 0.001 wt % to 0.005 wt %, or 0.01 wt %, or 0.05 wt %, or 0.1 wt %, based on the total weight of the DEF composition. Preferably, the titanium-containing salt or hydrate is present in the DEF composition in an amount from 0.0005 wt %, or 0.00075 wt %, or 0.001 wt %, or 0.0025 wt % to 0.005 wt %, or 0.0075 wt %, or 0.01 wt %, or 0.025 wt %, based on the total weight of the DEF composition.

Diesel Engine

In an embodiment, the DEF is for use with a diesel engine. In a particular embodiment, the DEF is for use with a diesel engine which uses SCR to reduce unwanted emissions.

A diesel engine with which the DEF may be used comprises an exhaust system which includes a DEF injector configured to inject an amount of DEF into an exhaust stream and an SCR catalyst. The diesel engine may be any type of diesel engine known in the art or later developed. The DEF injected into the exhaust stream is in accordance with any embodiment described herein.

In another embodiment, a method of reducing unwanted emissions in a diesel engine is provided. The method includes injecting a portion of DEF into an exhaust stream of a diesel engine and subjecting the exhaust stream to selective catalytic reduction. The DEF is in accordance with any embodiment described herein.

Example 1

To prepare the DEF, the constituents will be measured and mixed to the proportions as shown in Tables 2 and 3 using methods and materials known in the art. In the examples provided herein, the 3-dimensional siloxane component is an emulsion comprising (1) deionized water, (2) polyethylene-polypropylene glycol, (3) oxirane, methyl-, polymer with oxirane, mono-2-propyny ether; and (4) a blend of siloxanes.

TABLE 2

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Deionized Water | 67.47 | 67.45 | 67.49 | 67.42 | 66.45 | 53.99 | 67.42 | 67.45 | 67.49 |
| Urea | 32.50 | 32.50 | 32.50 | 32.50 | 32.50 | 20.00 | 31.55 | 30.50 | 12.50 |
| 3-Dimensional Siloxane Emulsion | 0.03 | 0.05 | 0.01 | 0.03 | 0.05 | 0.01 | 0.03 | 0.05 | 0.01 |
| Ammonia Formate | | | | 0.05 | 1.00 | 26.00 | | | |
| Ammonia Carbamate | | | | | | | 1.00 | 2.00 | 20.00 |
| Titanium Lactate | | | | | | | | | |

TABLE 2-continued

| | | | | | | | | | |
|---|---|---|---|---|---|---|---|---|---|
| Ammonium Salt | | | | | | | | | |
| Ammonium Titanyl Oxalate Mono hydrate | | | | | | | | | |
| | Ex. 10 | Ex. 11 | Ex. 12 | Ex. 13 | Ex. 14 | Ex. 15 | Ex. 16 | Ex. 17 | Ex. 18 |
| Deionized Water | 67.37 | 67 | 67.40 | 67.43 | 67.43 | 67.48 | 67.47 | 67.445 | 67.48 |
| Urea | 31.55 | 30.50 | 22.50 | 32.50 | 32.50 | 32.50 | 32.50 | 32.50 | 32.50 |
| 3-Dimensional Siloxane Emulsion | 0.03 | 0.05 | 0.01 | 0.03 | 0.05 | 0.01 | 0.03 | 0.05 | 0.01 |
| Ammonia Formate | 0.05 | 0.50 | 5.00 | | | | | | |
| Ammonia Carbamate | 1.00 | 1.50 | 5.00 | | | | | | |
| Titanium Lactate Ammonium Salt | | | | 0.0009 | 0.001 | 0.01 | | | |
| Ammonium Titanyl Oxalate Mono hydrate | | | | | | | 0.0005 | 0.005 | 0.009 |

TABLE 3

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Deionized Water | 67.43 | 67.39 | 67.39 | 67.38 | 66.39 | 53.89 | 67.38 | 67.39 | 67.39 |
| Urea | 32.50 | 32.50 | 32.50 | 32.50 | 32.50 | 20.00 | 31.55 | 30.50 | 12.50 |
| Tridecyl Alcohol Ethoxylates | 0.04 | 0.06 | 0.10 | 0.04 | 0.06 | 0.10 | 0.04 | 0.06 | 0.10 |
| 3-Dimensional Siloxane Emulsion | 0.03 | 0.05 | 0.01 | 0.03 | 0.05 | 0.01 | 0.03 | 0.05 | 0.01 |
| Ammonia Formate | | | | 0.05 | 1.00 | 26.00 | | | |
| Ammonia Carbamate | | | | | | | 1.00 | 2.00 | 20.00 |
| Titanium Lactate Ammonium Salt | | | | | | | | | |
| Ammonium Titanyl Oxalate Mono hydrate | | | | | | | | | |
| | Ex. 10 | Ex. 11 | Ex. 12 | Ex. 13 | Ex. 14 | Ex. 15 | Ex. 16 | Ex. 17 | Ex. 18 |
| Deionized Water | 67.38 | 67.36 | 67.39 | 67.43 | 67.39 | 67.38 | 67.43 | 67.385 | 67.38 |
| Urea | 31.55 | 30.50 | 22.50 | 32.50 | 32.50 | 32.50 | 32.50 | 32.50 | 32.50 |
| Tridecyl Alcohol Ethoxylates | 0.04 | 0.06 | 0.10 | 0.04 | 0.06 | 0.10 | 0.04 | 0.06 | 0.10 |
| 3-Dimensional Siloxane Emulsion | 0.03 | 0.05 | 0.01 | 0.03 | 0.05 | 0.01 | 0.03 | 0.05 | 0.01 |
| Ammonia Formate | 0.05 | 0.50 | 5.00 | | | | | | |

TABLE 3-continued

| | | | | | | | | | |
|---|---|---|---|---|---|---|---|---|---|
| Ammonia Carbamate | 1.00 | 1.50 | 5.00 | | | | | | |
| Titanium Lactate | | | | 0.0009 | 0.001 | 0.01 | | | |
| Ammonium Salt | | | | | | | | | |
| Ammonium Titanyl Oxalate Mono hydrate | | | | | | | 0.0005 | 0.005 | 0.009 |

Example 2

The following DEF was tested for the ability to reduce deposit formation in a diesel exhaust system:

TABLE 4

| DEF Formula | | | |
|---|---|---|---|
| | % bw | | |
| Component | Min | Target | Max |
| Deionized Water | 67.43% | 67.39% | 67.3% |
| Urea | 32.5% | 32.5% | 32.5% |
| 3-Dimensional Siloxane Emulsion | 0.03% | 0.05% | 0.1% |
| Tri decylalcohol ethoxylates | 0.04% | 0.06% | 0.1% |

The laboratory evaluations were performed using the testing equipment depicted in FIG. 1. As shown in FIG. 1, the Diesel Particulate Filter (DPF)/Diesel Oxidation Catalyst (DOC) was installed upstream of DEF Injector for soot removal. A Bosch Denoxtronix 2.2 DEF Injector was used for this evaluation. A static mixer was placed 2" downstream of DEF injection point.

At the conclusion of each test the static mixer and exhaust pipe elbow regions were removed, and deposit formation was gravimetrically quantified at each point. The test conditions were designed to evaluate deposit mitigation performance under severe conditions using standard 32.5% DEF as the baseline.

The solution injection rate was 2300 g/hr across all temperature ranges and fluid types. The exhaust flow rate was 660. The performance of the technology was evaluated at the following exhaust gas temperatures: 180° C.; 200° C.; and 250° C.

Figure 2:
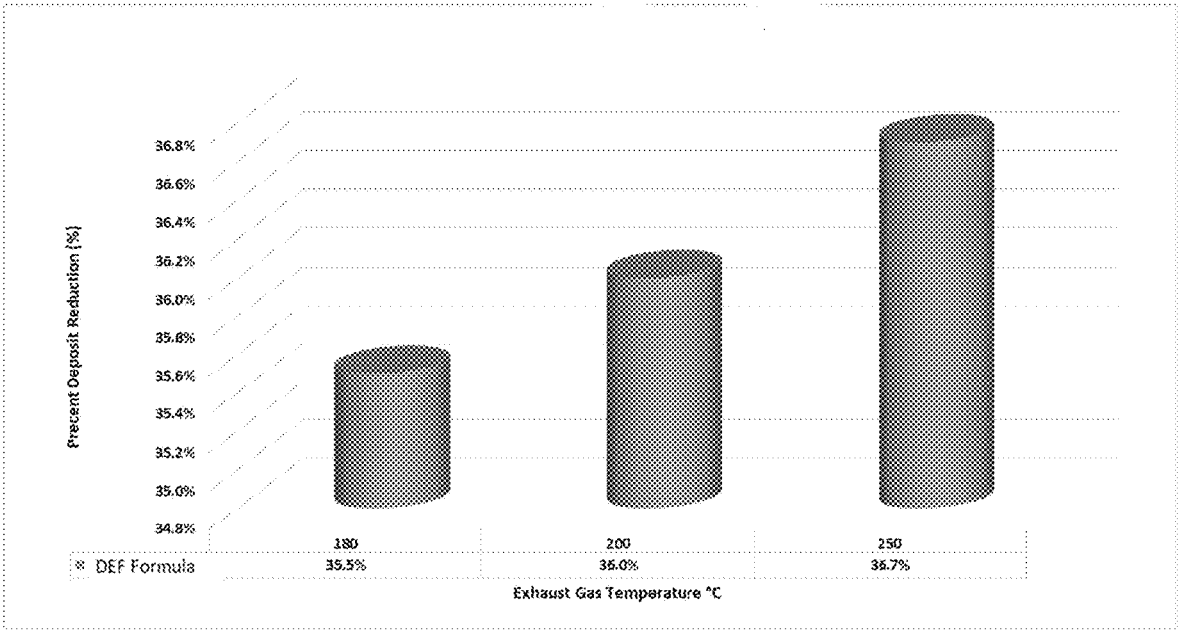
FIG. 2 is a graph showing that a DEF formulation having water, urea, 3-dimensional siloxane emulsion and tridecyl ethoxylates can reduce deposit formation in a diesel exhaust system as compared to standard 32.5% DEF.

As shown in FIG. 2, the DEF formulation of Table 4 (DEF Formula) reduced the formation of deposits by an average of 36% when compared to Standard 32.5% DEF under comparable conditions.

Figure 3:
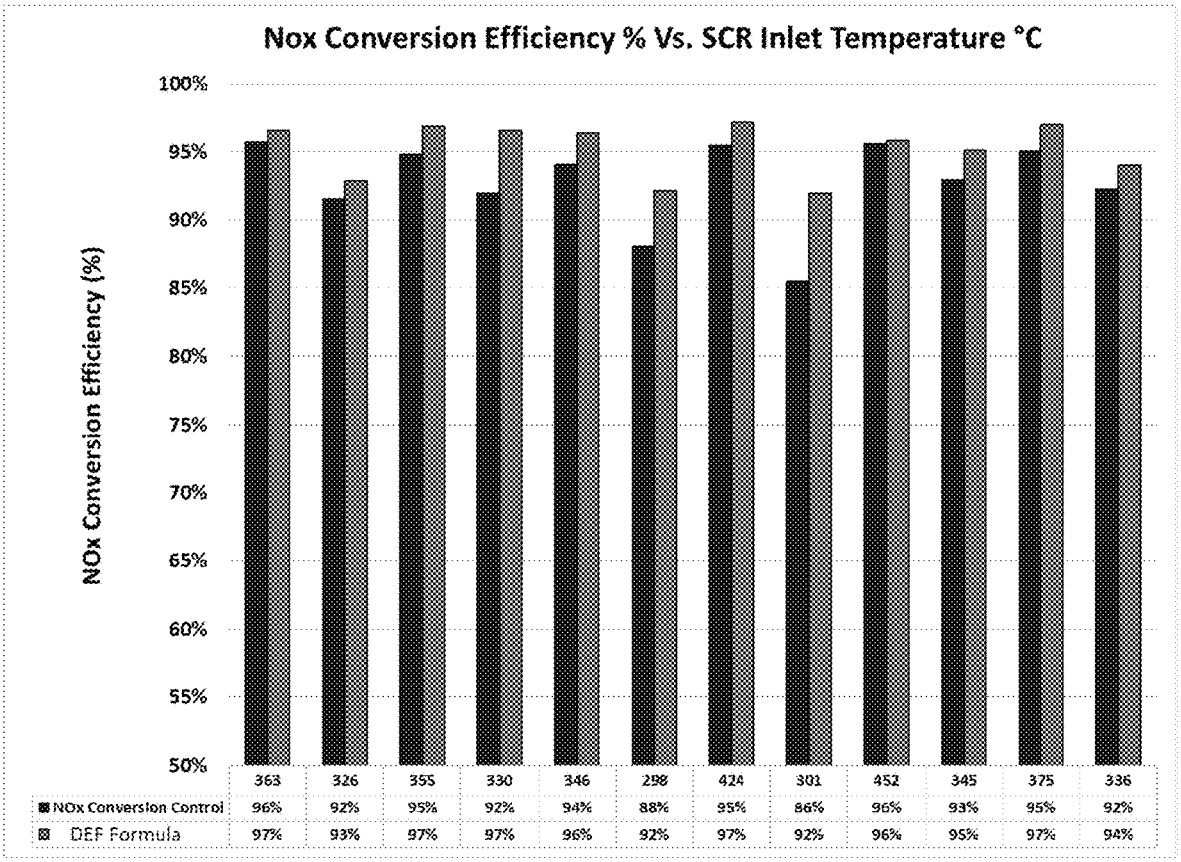
FIG. 3 is a bar graph showing that a DEF having water, urea, a 3-dimensional siloxane emulsion and tridecyl ethoxylates has better NOx conversion efficiency as compared to Standard 32.5% DEF at typical SCR dosing temperatures. Over the temperature range tested, DEF having water, urea, a 3-dimensional siloxane emulsion and tridecyl ethoxylates displayed an average of 2.5% improvement in NOx conversion efficiency.

As shown in FIG. 3, using a complete Cummins SCR System MY13-16, DEF formulation of Table 4 exhibited better NOx conversion efficiency when compared to Standard 32.5% DEF at typical SCR dosing temperatures. Over the temperature range tested, the DEF formulation of Table 4 demonstrated an average of 2.5% improvement in NOx conversion efficiency While various embodiments of the DEF composition have been described in detail, it should be apparent that modifications and variations thereto are possible, all of which fall within the true spirit and scope of the present disclosure. With respect to the above description then, it is to be realized that the optimum constituents of the disclosed technology, to include variations in amount, chemical structure, and method of mixing, are deemed readily apparent and obvious to one skilled in the art, and all equivalent constituents and amounts to those described in the specification are intended to be encompassed by the present disclosure. Therefore, the foregoing is considered as illustrative only of the principles of the disclosure only. Further, since numerous modifications and changes will readily occur to those skilled in the art, it is not desired to limit the technology to the exact composition shown and described, and accordingly, all suitable modifications and equivalents may be resorted to, falling within the scope of the present disclosure.

What is claimed is:

1. A composition comprising:

(a) water;

(b) urea; and (c) a 3-dimensional siloxane component with polydimethylsiloxane, wherein the polydimethylsiloxane is from 5 wt % to 12 wt % based on total weight of the 3-dimensional siloxane emulsion.

2. The composition of claim 1 comprising 45-75 wt % water, based on the total weight of the diesel exhaust fluid.

3. The composition of claim 2 comprising 5-40 wt % urea, based on the total weight of the diesel exhaust fluid.

4. The composition of claim 1 further comprising a tridecyl alcohol ethoxylates in an amount from 0.01 to 0.16 wt %, based on the total weight of the diesel exhaust fluid.

5. The composition of claim 1 comprising 0.0001-0.5 wt % of the 3-dimensional siloxane component, based on the total weight of the diesel exhaust fluid.

6. The composition of claim 1 further comprising an ammonium-containing salt in an amount from greater than 0 wt % to 30 wt %, based on the total weight of the diesel exhaust fluid.

7. The composition of claim 1 further comprising a titanium-containing salt or hydrate in an amount from greater than 0 wt % to 0.1 wt %, based on the total weight of the diesel exhaust fluid.

8. The composition of claim 6, wherein the ammonium containing salt is selected from the group consisting of ammonium carbonate, ammonium chloride, ammonium nitrate, ammonium carbamate, ammonium formate, and combinations thereof.

9. The composition of claim 6, wherein the ammonium-containing salt is free from metals and transition metals.

10. The composition of claim 1, wherein the 3-dimensional siloxane component is an emulsion comprising a mixture of polymers containing siloxane units and terminating in trimethyl end caps dispersed in a water-based continuous phase.

11. The composition of claim 10, wherein the 3-dimensional siloxane component further comprises at least one of the reaction product of dimethyl siloxane and silica, the reaction products of polyethylene-polypropylene glycol monoallyl ether and vinyl group-terminated di-methyl siloxanes, and combinations thereof.

12. The composition of claim 1, wherein the composition is used in the selective catalytic reduction of exhaust from a diesel engine.

* * * * *